US005899260A

United States Patent [19]

Hulek

[11] Patent Number: 5,899,260

[45] Date of Patent: May 4, 1999

[54] CRAWLER-MOUNTED INGOT MOLD FOR A CONTINUOUS CASTING PLANT

[76] Inventor: Anton Hulek, Goglerfeldgasse 15, A-4040 Linz, Austria

[21] Appl. No.: 08/800,271

[22] Filed: Feb. 13, 1997

[30] Foreign Application Priority Data

Feb. 20, 1996 [AT] Austria ..... A308/96

[51] Int. Cl.[6] ..... B22D 11/06

[52] U.S. Cl. ..... 164/430; 164/479

[58] Field of Search ..... 164/430, 431, 164/479

[56] References Cited

U.S. PATENT DOCUMENTS

| | | | |
|---|---|---|---|
| 342,920 | 6/1886 | Matthes et al. | 164/430 |
| 1,139,887 | 5/1915 | Mellen | 164/430 |
| 1,841,297 | 1/1932 | Perry et al. | 164/430 X |
| 4,331,195 | 5/1982 | Webber . | |

FOREIGN PATENT DOCUMENTS

| | | | |
|---|---|---|---|
| 381 878 | 5/1986 | Austria . | |
| 388 688 | 1/1989 | Austria . | |
| 0 271 603 | 6/1988 | European Pat. Off. . | |
| 0 288 626 | 11/1988 | European Pat. Off. . | |
| 57-56140 | 4/1982 | Japan | 164/479 |
| 58-35048 | 3/1983 | Japan | 164/431 |
| 61-176450 | 8/1986 | Japan | 164/430 |

*Primary Examiner*—J. Reed Batten, Jr.
*Attorney, Agent, or Firm*—Collard & Roe, P.C.

[57] ABSTRACT

The mold comprises two crawler chains rotating in opposite directions and having facing chain strands, the chain strands comprising chain elements having complementary shells defining an ingot mold cavity of round cross-section therebetween. The complementary shells have intermeshing longitudinal edges movable transversely to the direction of rotation relative to each other, and the complementary shells are guided to reduce the round cross-section of successive ones of the mold cavities while being subjected to a compressive stress.

9 Claims, 4 Drawing Sheets

CRAWLER-MOUNTED INGOT MOLD FOR A CONTINUOUS CASTING PLANT

Figure 1:
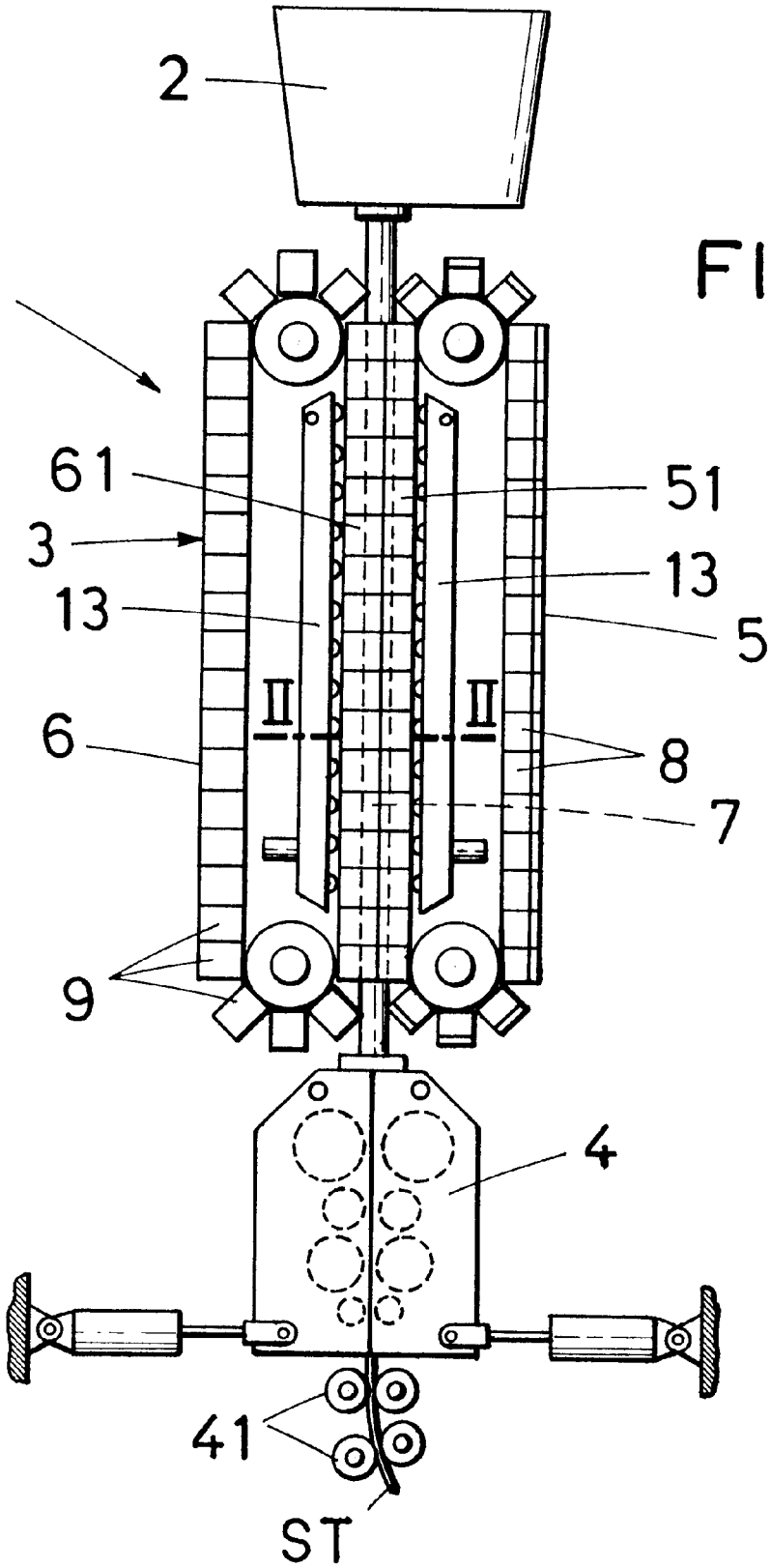

This invention relates to a crawler-mounted ingot mold for a continuous casting plant, comprising two opposing crawler chains rotating in opposite directions, which between their cooperating chain strands define the ingot mold cavity, where the chain elements of the two crawler chains constitute shells completing each other to a round cross-section in the vicinity of the cooperating chain strands.

Ingot molds used in continuous casting on the one hand serve to shape the cast strand, and on the other hand provide for an intensive dissipation of heat, which is required for a fast solidification of the strand. As compared to stationary ingot molds, moving ingot molds have the advantage that with a given intensive contact between strand surface and ingot mold, which is favorable both for shaping and for the dissipation of heat, higher casting speeds and thus a higher casting output can be achieved due to the lack of a relative sliding movement between strand and ingot mold. However, the close contact between ingot mold and strand can so far only be achieved with flat strand cross-sections, where the shrinkage of material can be compensated by minor relative movements of the lateral web walls of multi-part ingot molds (AT-B 381,878). Round cross-sections, however, lead to considerable difficulties, as the shells of the crawler-mounted ingot mold completing each other to a round cross-section must completely surround the strand, and in the known ingot molds the shells abutting against each other with their longitudinal edges can so far not provide for a change of the cross-section along the ingot mold cavity (U.S. Pat. No. 4,331,195). As a result of the shrinkage of the strand due to cooling, the strand is detached from the ingot mold, which substantially impairs not only the shaping, but also the dissipation of heat and leads to a very nonuniform solidification of the strand.

It is therefore the object underlying the invention to eliminate these deficiencies and create a crawler-mounted ingot mold as described above, which provides for an economic and nevertheless high-quality continuous casting of round cross-sections, where round cross-section is meant to include not only the circular cross-section, but also oval cross-sections and those composed by arc sections and short straight sections.

This object is solved by the invention in that the associated shells have longitudinal edges intermeshing relatively movably transverse to the direction of rotation, and adjacent the cooperating chain strands the chain elements are guided in the sense of a reduction of the round cross-section and can be subjected to a compressive stress. Due to the intermeshing longitudinal edges of the two shells providing the round cross-section, these shells can be moved relative to each other in transverse direction despite a closed cross-sectional shape, so that reductions of the cross-section can be achieved. By means of a corresponding joining and application of pressure, the associated shells can be urged against the cast strand during their movement along the ingot mold cavity, and phenomena of contraction and shrinkage will follow over the entire area of the ingot mold without a risk of detachment between shell mold and strand surface, so that independent of the casting speed or the speed of rotation there is always ensured an intensive contact between ingot mold and strand at all points, and on the one hand the exact shaping, and on the other hand the high heat flux density for cooling is ensured. The high cooling effect of the shells to be pressed onto the strand provides for the use of the crawler-mounted ingot mold as primary ingot mold and ensures a fast solidification of the strand. The crawler-mounted ingot mold can, however, also be used as a secondary ingot mold for the further cooling of a strand already solidified, so that a complete solidification is accelerated, and the formation of segregations in the core portion as a result of the fast solidification is avoided.

In the case of smaller cross-sections and a minor shrinkage the longitudinal edges of the shells may be bevelled in opposite directions, and at least one of the associated shells may have flexural elasticity in direction of curvature, so that the reduction of the cross-section is achieved via an elastic deformation of at least one of the shells. As shell material a correspondingly flexurally elastic material, such as copper alloys or the like, is recommended, which also provides for a good dissipation of heat.

When the chain elements constituting the flexurally elastic shell have longitudinal slots adjacent the curvature on the rear side facing away from the shells, the remaining web portions between the longitudinal slots on the side of the shell facilitate the elastic deformability of the shell and prevent a premature formation of cracks.

In accordance with a particularly advantageous aspect of the invention the one chain elements have a substantially U-shaped basic body, and the other chain elements have a substantially stamp-shaped basic body fittingly engaging between the leg walls of the U-shaped basic body, where the inner apex portion of the U-shaped basic body and the concave end face portion of the stamp-shaped basic body constitute shells completing each other to the round cross-section. As a result of these basic bodies directly movable into each other an elastic deformation of the shells is not necessary, and relatively large relative movements can be achieved without a risk of breaking and without a plastic deformation of the shells. In this way, large cross-sectional areas can be covered, where reductions of the cross-section beyond a measure determined by the contraction or shrinkage of material are possible, which can lead to a deliberate reduction of the cross-section of the strand inside the ingot mold, which influences the microstructure. For applying the compressive stress and for performing the adjusting movements, at least one of the crawler chains will be mounted in an appropriately supported and loadable frame or the like, so that correspondingly high compressive forces can be applied.

The crawler-mounted ingot mold in accordance with the invention is of course suited for the vertical continuous casting as a vertical ingot mold, where it is necessary to deflect the resulting strand into the horizontal for the further processing. As a result of the good conditions as regards the dissipation of heat, and due to the dissipative effect resulting from the moving ingot mold, the crawler-mounted ingot mold is preferably also suited for use as moving inclined or horizontal ingot mold, where in the inlet portion of the chain strands defining the ingot mold cavity there is provided a sealing plunger melt-tightly protruding between the associated shells of the chain elements, through which sealing plunger an inner casting pipe connected to a casting device opens into the ingot mold cavity. Such lying arrangement of the ingot mold prevents a greater deflection of the strand behind the ingot mold, reduces the required overall height, and in addition has the advantage that during continuous casting the ferrostatic pressure remains approximately constant over the entire length of the strand. By means of the compression between shells and strand, which can be achieved with the ingot mold, and by a corresponding length of the ingot mold casting speeds between 20 and 40 m/min and more can be achieved, where the supply of the melt is suitably effected via a casting pipe, which extends through the sealing plunger sealing the ingot mold cavity into the ingot mold cavity. With their shells, the chain elements surround the plunger, whose cross-section has been adapted to the round cross-section of the strand, and slide over the stationary plunger relative to the plunger at the casting speed in casting direction, where directly behind the plunger the strand starts to solidify as a result of the high dissipation of heat via the chain elements, and a strand shell is formed continuously and in line with the movement.

When the sealing plunger consists of a ceramic body with a peripheral sliding layer, preferably of sintered metal, and when the casting pipe has a hopper throat, where preferably the sliding layer terminates at a distance before the end face on the side of the throat, perfect technological conditions can be achieved even in the delicate initial portion of the strand formation. The ceramic plunger has a heat insulating property and prevents an overheating of the outer sliding layer which, possibly provided with a lubrication, provides for a low-friction sliding movement of the chain elements. The casting pipe provided with a hopper throat ensures a uniform distribution of the melt over the cross-section of the ingot mold and a uniform formation of the strand shell along the round cross-section. The distance between the end face of the sealing plunger on the side of the throat and the peripheral sliding layer interrupts a possible conduction of heat towards the sliding layer, so that a clean start of the solidification is obtained for the strand shell.

In the case of a horizontal ingot mold the cooperating chain strands are expediently disposed one on top of the other, and the longitudinal edges of the shells of the lower chain elements engage over the shells of the upper chain elements on the outside, so that there are no sealing problems, and the melt can easily be collected. An advantageous constructive solution is obtained, when the upper chain strand can be subjected to a compressive stress against the fixedly supported lower chain strand, so that only one of the crawler chains must be movably supported, and in addition the gravity of these movably supported crawler chains can be utilized for subjecting the cooperating chain strands to a compressive stress.

Figure 2:
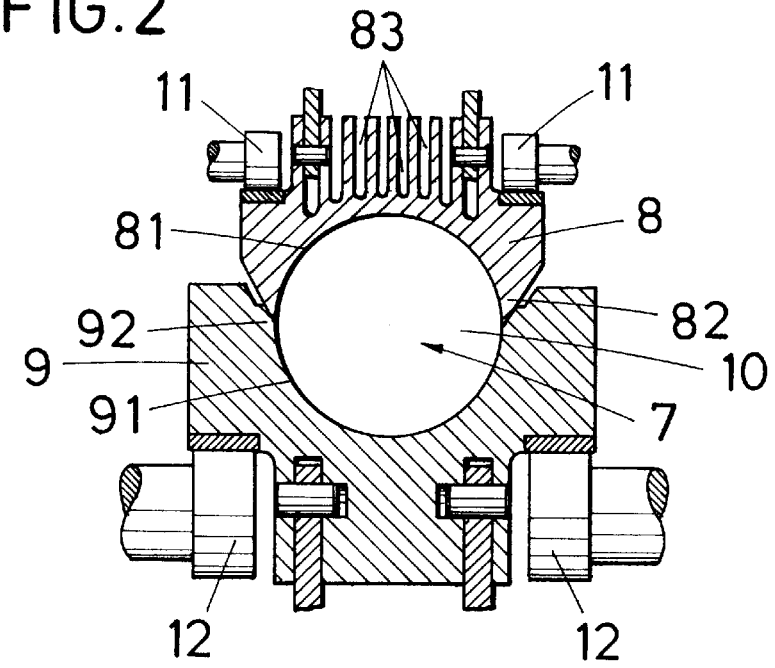
Figure 3:
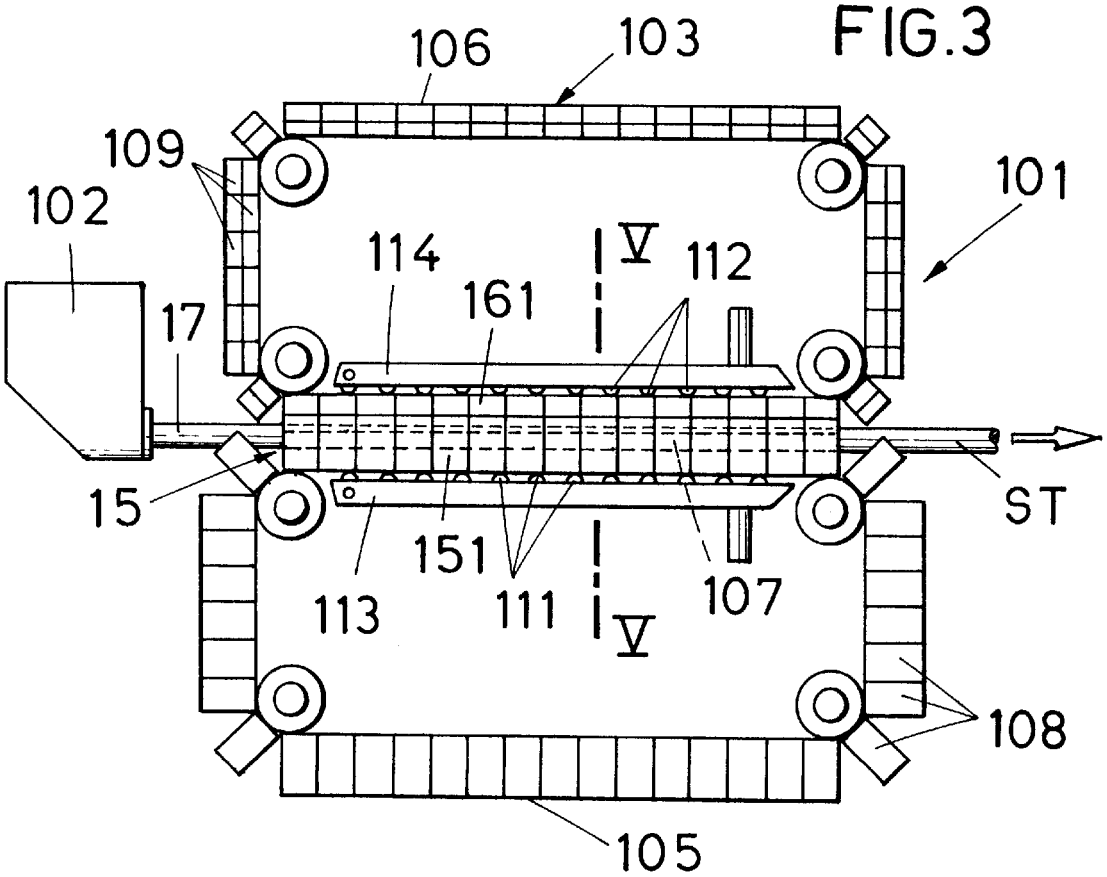
Figure 4:
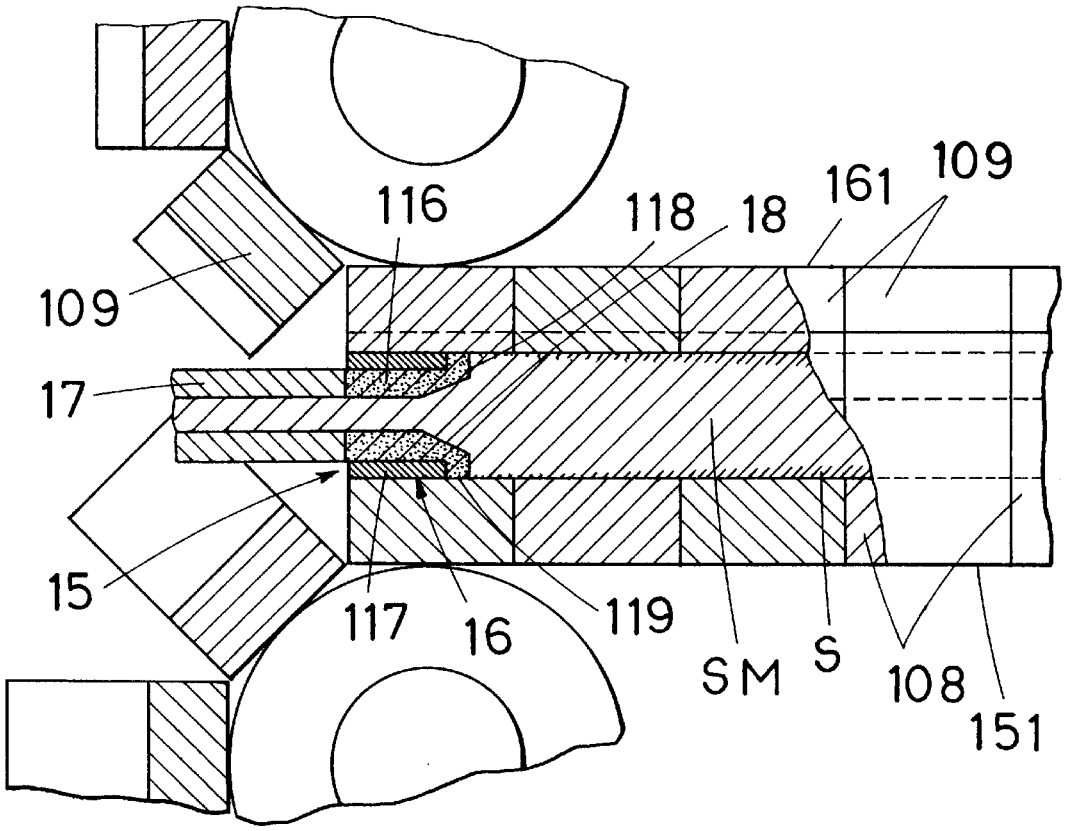
Figure 5:
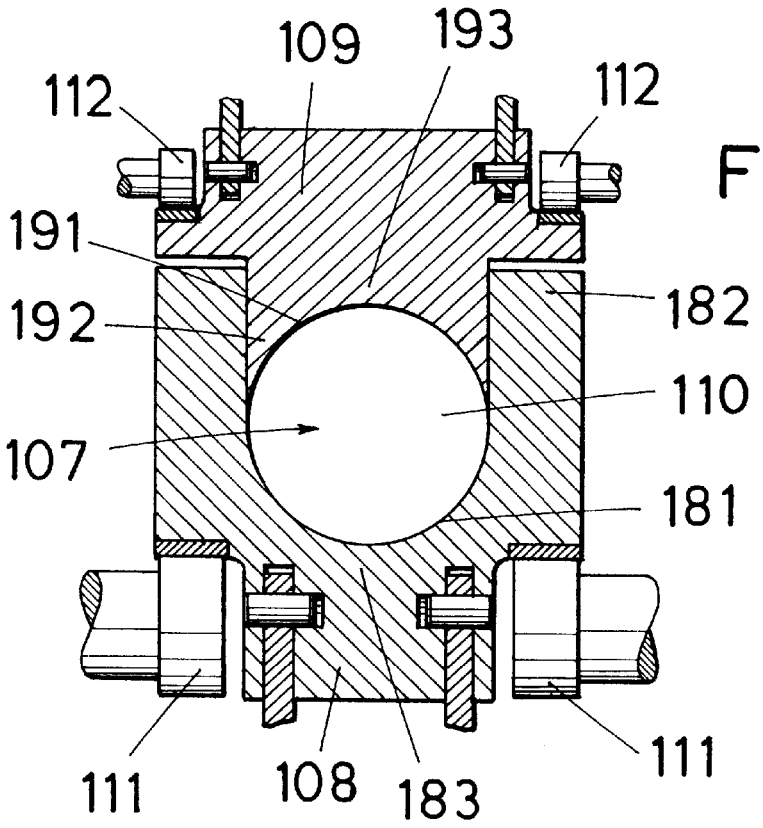
Figure 6:
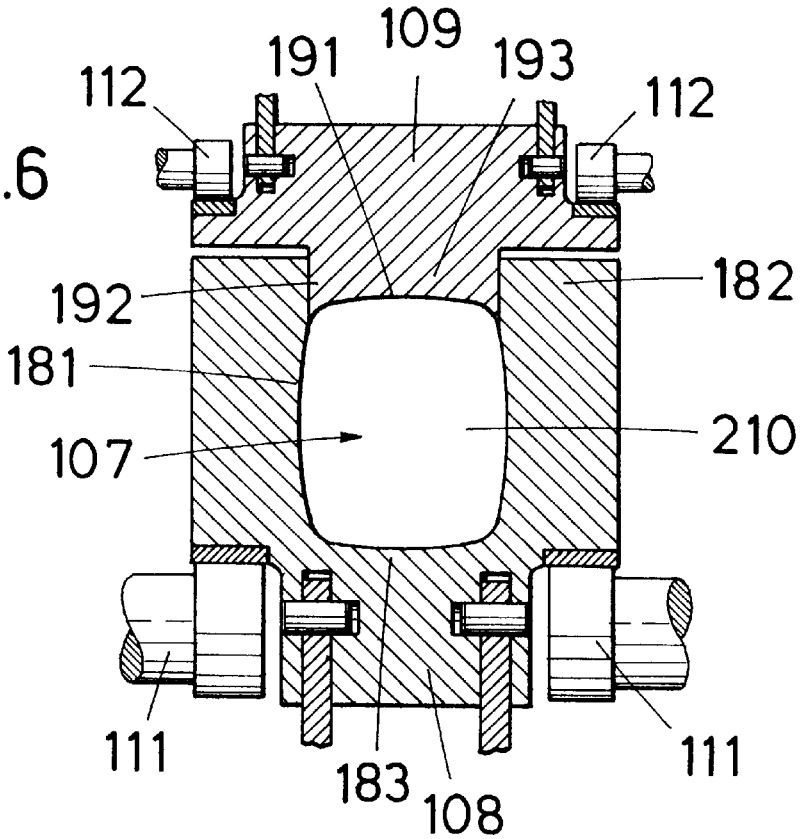

In the drawing, the subject-matter of the invention is illustrated purely schematically, wherein FIG. 1 shows part of a vertical continuous casting plant with an inventive crawler-mounted ingot mold in a schematic representation, FIG. 2 shows a cross-section through the plate mold along line II—II of FIG. 1 on an enlarged scale, FIG. 3 shows part of a horizontal continuous casting plant, likewise with an inventive crawler-mounted ingot mold in a schematic representation, FIG. 4 shows a detail of this plant on an enlarged scale, FIG. 5 shows a cross-section through the crawler-mounted ingot mold along line V—V of FIG. 3, and FIG. 6 shows a modified embodiment of the plate mold in a sectional representation similar to FIG. 4.

In accordance with the embodiment shown in FIG. 1 and 2, a vertical continuous casting plant 1 comprises a casting device 2, a crawler-mounted ingot mold 3 as well as a deforming means 4 subsequent to the crawler-mounted ingot mold 3 with succeeding deflection rollers 41 for the resulting strand ST. The crawler-mounted ingot mold 3 has two opposing crawler chains 5, 6 rotating in opposite directions, which between their cooperating chain strands 51, 61 define the ingot mold cavity 7. The chain elements 8, 9 of the two crawler chains 5, 6 constitute shells 81, 91 completing each other to a round cross-section 10 in the vicinity of the cooperating chain strands 51, 61.

To compensate a shrinkage of material during the solidification of the strand, and to ensure an intensive contact between strand and ingot mold over the entire length of the ingot mold and the entire periphery of the ingot mold, the associated shells 81, 91 have intermeshing longitudinal edges 82, 92, which are bevelled in opposite directions and are thus supported on each other relatively movably. By means of supporting rollers 11, 12, the chain elements 8, 9 are subjected to a compressive stress in the vicinity of the cooperating chain strands 51, 61 in the sense of a reduction of the round cross-section 10, where the one chain elements 8 constitute a flexurally elastic shell 81. For this purpose, the chain elements 8 are made of a copper alloy or the like and adjacent the curvature have longitudinal slots 83 on the rear side facing away from the shell, so as to achieve a relative movability with respect to the chain elements 9 through a flexurally elastic deformation and to provide for an adaptation to the reduction of the cross-section. To compensate the shrinkage of the cross-section of the solidifying strand ST, the chain strands 51, 61 thus conically converge towards each other in direction of rotation, which a priori can be accounted for by a corresponding inclined arrangement of the crawler chains. In addition, an active compressive stress can of course be applied via the supporting rollers 11, 12 and a pressing means 13 for intensifying the contact between ingot mold and melt or strand.

In accordance with the embodiment shown in FIG. 3, 4 and 5, 6 there is provided a horizontal continuous casting plant 101 comprising a casting device 102 and a horizontal crawler-mounted ingot mold 103. Here as well, the crawler-mounted ingot mold has two opposing crawler chains 105, 106 rotating in opposite directions, which between their cooperating chain strands 151, 161 define the ingot mold cavity 107, where the chain elements 108, 109 constitute shells 181, 191 completing each other to a round cross-section 110, where the longitudinal edges 182, 192 of said shells are intermeshing relatively movably. The chain elements 108 of the crawler chains 105 are, however, provided with a substantially U-shaped basic body 183, and the chain elements 109 of the crawler chain 106 are provided with a substantially stamp-shaped basic body 193, which stamp-shaped basic body 193 fittingly engages between the leg walls of the basic body 183 constituting the longitudinal edges 182. Here as well, supporting wheels 111, 112 provide for a mutual compressive stress, where the supporting wheels for the lower crawler chain 105 can be subjected to a compressive stress via a pressing means 113, and the supporting wheels for the upper crawler chain 106 can be subjected to a compressive stress via a pressing means 114.

In the inlet portion 15, the ingot mold cavity 107 is sealed by a sealing plunger 16 protruding between the chain elements 108, 109, through which sealing plunger extends a casting pipe 17 with a hopper throat 18, which is connected to the casting means 102. The sealing plunger 16 has a ceramic body 116 and is provided with a sliding layer 117 on its periphery, where between the sliding layer 117 and the end face 118 on the side of the throat there remains a heat-insulating portion 119. The melt material SM flowing into the ingot mold cavity 107 through the casting device 102 and the casting pipe 17 is withdrawn through the close contact with the chain elements and is passed on and at the same time intensively cooled for the formation of a continuous strand shell S, so that a perfect strand ST with a round cross-section is produced.

As is indicated in FIG. 5 and 6, the basic bodies 183, 193 of the chain elements 108, 109, which constitute the shells 181, 191 with their concave apex portions on the one hand and their concave end faces on the other hand, can define different round cross-sections, for instance an approximately circular cross-section 110 in accordance with FIG. 5, or a rounded square or rectangular cross-section 210 in accordance with FIG. 6. It is merely important that no edged cross-sections are produced, as these edges above all impede the uniform transmission and distribution of pressure in the strand shell over the strand periphery, and thus impair the cooling and solidification conditions.

I claim:

1. A crawler-mounted ingot mold for a continuous casting plant, which comprises two crawler chains rotating in opposite directions and having facing chain strands, the chain strands comprising chain elements having complementary shells defining an ingot mold cavity of round cross-section therebetween, the complementary shells having intermeshing longitudinal edges movable transversely to the direction of rotation relative to each other, the longitudinal edges of the shells being bevelled in opposite directions, at least one of the complementary shells having a flexural elasticity in a direction of curvature extending transversely to the direction of rotation, and the complementary shells being guided to reduce the round cross-section of successive ones of the mold cavities while being subjected to a compressive stress.

2. The crawler-mounted ingot mold of claim 1, wherein the chain elements of one of the facing chain strands have a substantially U-shaped basic body with two legs and an inner apex portion, and the chain elements of the other facing chain strand have a substantially stamp-shaped basic body extending between, and fittingly engaging, the two legs, the stamp-shaped basic body having a concave end face portion, the inner apex portion of the U-shaped basic body and the concave end face portion of the stamp-shaped basic portion constituting the complementary shells.

3. The crawler-mounted ingot mold of claim 1, wherein the facing chain strands define an ingot mold cavity inlet portion for molten ingot material, further comprising a sealing plunger melt-tightly protruding between the complementary shells of a respective one of the chain elements at the inlet portion, and a casting pipe connecting a casting device to the sealing plunger and opening into the ingot mold cavity.

4. The crawler-mounted ingot mold of claim 3, wherein the sealing plunger is a ceramic body having a peripheral sliding layer, and the casting pipe opens into the ingot mold cavity with an outwardly converging throat.

5. The crawler-mounted ingot mold of claim 4, wherein the sliding layer is of sintered metal.

6. The crawler-mounted ingot mold of claim 4, wherein the outwardly converging throat has an end face, and the sliding layer terminates at a distance from the end face.

7. The crawler-mounted ingot mold of claim 1, wherein the facing chain strands comprise a lower chain strand and an upper chain strand on top of the lower chain strand, and the longitudinal edges of the shells of the chain elements of the lower chain strand extend over the longitudinal edges of the shells of the chain elements of the upper chain strand.

8. The crawler-mounted ingot mold of claim 7, wherein the lower strand is fixedly supported and the upper strand is subjected to the compressive stress.

9. A crawler-mounted ingot mold for a continuous casting plant, which comprises two crawler chains rotating in opposite directions and having facing chain strands, the chain strands comprising chain elements having complementary shells defining an ingot mold cavity of round cross-section therebetween, the complementary shells having intermeshing longitudinal edges movable transversely to the direction of rotation, and the complementary shells being guided to reduce the round cross-section of successive ones of the mold cavities while being subjected to a compressive stress, the longitudinal edges of the shells being bevelled in opposite directions, and at least one of the complementary shells having a flexural elasticity in a direction of curvature extending transversely to the direction of rotation, the one complementary shell having longitudinal slots adjacent the curvature a rear side of the shell facing away from the mold cavity.

* * * * *